US006116376A

United States Patent [19]

Chu

[11] Patent Number: 6,116,376

[45] Date of Patent: Sep. 12, 2000

[54] STRUCTURE OF A MUFFLER

[76] Inventor: Chien-Wen Chu, 11F1-, No. 1, Lane 160, Sec. 3, Min-Chuan E. Rd., Taipei, Taiwan

[21] Appl. No.: 09/339,034

[22] Filed: Jun. 23, 1999

[51] Int. Cl.[7] ..... F01N 1/08

[52] U.S. Cl. ..... 181/256; 255/272

[58] Field of Search ..... 181/255, 256, 181/257, 258, 264, 269, 272, 275, 282

[56] References Cited

U.S. PATENT DOCUMENTS

| | | | |
|---|---|---|---|
| 4,116,301 | 9/1978 | Trudell | 181/252 |
| 4,372,421 | 2/1983 | Jackson | 181/272 |

*Primary Examiner*—Khanh Dang
*Attorney, Agent, or Firm*—Bacon & Thomas, PLLC

[57] ABSTRACT

A muffler which reduces engine noise at lower operating speeds includes two spacers installed within a cylinder that is divided into a front chamber, a resonance canceling chamber and a noise canceling chamber. A first pressure returning tube and a second pressure returning tube are serially connected within the cylinder and a plurality of gas holes are circularly installed within the first pressure returning tube and the second pressure returning tube so that the first pressure returning tube and the second pressure returning tube pass through the front chamber, resonance cancelling chamber and noise cancelling chamber. A spacer circularly installed with a plurality of through holes is installed within the front chamber and the latter is divided into an expansion chamber and an air pressure regulating chamber. A central hole is located in the center of the spacer. The front end of the first pressure returning tube is placed in the central hole of the spacer and a gap is formed between the front end of first pressure returning tube and the central hole of the spacer.

1 Claim, 3 Drawing Sheets

STRUCTURE OF A MUFFLER

FIELD OF THE INVENTION

The present invention relates to an improved structure of a muffler, wherein the muffler is divided into a front chamber, a resonance canceling chamber, and a noise canceling chamber. The front chamber is divided into an expansion chamber and a gas pressure regulating chamber. A first and a second pressure returning tubes are serially connected therebetween. As the engine rotates in a lower speed, the waste gas will flow into the expansion chamber firstly, then flows into the air pressure regulating chamber, finally returning back to the expansion chamber so that the waste gas flows into the first pressure returning tube. Further, the waste gas will flow to the resonance canceling chamber, and the noise canceling chamber so as to reduce the noise in the lower rotary speed of the engine.

BACKGROUND OF THE INVENTION

In general, the waste gas exhausted from a car as the engine thereof is operated. If the waste gas is exhausted to outer environment, a large noise will be induced. Therefore, the exhausting tube of an engine must be connected with a muffler in series for reducing the noise as gas is exhausted.

In a prior art muffler, an exhausting tube with holes is installed on one end of a cylinder, while another end is installed with a gas inlet. Spacers with through holes are installed on the outer cylinder. Voice canceling sponge is filled to the inner wall of the outer cylinder. When waste gas from the engine of a car flows to the outer cylinder from the exhausting tube, since the outer cylinder is installed with a spacers. Therefore, the waste gas exhausted will generate a turbulent flow so to reduce the noise from the exhaustion of waste gas. Moreover, the voice canceling sponge serves to reduce the noise due to the turbulent flow.

Since the waste gas from the exhaustion of the waste gas will be turbulent by the spacers in the outer cylinder. While the spacer will hinder the waste gas so as not to be exhausted smoothly. Therefore, the efficiency is reduced.

In order to reduce the effect that the waste gas is exhausted non-smoothly, the muffler is changed as a straight type. In this straight type muffler, a net tube with holes is longitudinally formed on the cylinder. Voice canceling cotton is filled between the net tube and the cylinder. Since the net tube is connected to the exhausting tube of an engine, as waste gas is exhausted to the muffler, the flow of waste gas will not be hindered completely. Thus, the exhausting gas will flow smoothly. Therefore, the bad effect of the exhausting gas to the engine is reduced.

While as the engine is operated in lower speed, a large amount of waste gas will be generated. Although a net tube is installed within the muffler for generating turbulent flow, a large waste gas will not generated with turbulent flow, thus, almost no any turbulent flow will be generated. Thus, a large noise will induce gas is exhausted and the voice is very piercing so that the noise can not be reduced effectively. Therefore, the object of the muffler can not be achieved.

SUMMARY OF THE INVENTION

Accordingly, the primary object of the present invention is to provide an improved structure of a muffler, wherein two spacers are installed within a cylinder, the cylinder is divided into a front chamber, a resonance canceling chamber and a noise canceling chamber. A first pressure returning tube and a second pressure returning tube are serially connected within the cylinder. A plurality of gas holes are circularly installed within the first pressure returning tube and the second pressure returning tube so that the first pressure returning tube and the second pressure returning tube passes through the front chamber. Resonance canceling chamber and noise canceling chamber. Characterized in that: a spacer circularly installed with a plurality of through holes is installed within the front chamber. The front chamber is divided into an expansion chamber and an air pressure regulating chamber. A central hole is located in the center of the spacer. The front end of the first pressure returning tube is placed in the central hole of the spacer. A proper gap is formed between the front end of first pressure returning tube and the central hole of the spacer. According to the aforementioned structure, as the engine rotates with a lower speed, since the waste gas is vented slowly, thus the waste gas will flow into the expansion chamber. Then the waste gas flows into the air pressure regulating chamber, and then returning back to the expansion chamber through the gap between the central hole of the spacer and the first pressure returning tube. The waste gas flows into the first pressure returning tube. Further, the waste gas will flow to the resonance canceling chamber, and the noise canceling chamber so as to reduce the noise in the lower rotary speed of the engine.

Therefore, in order to achieved the aforementioned object, an improved structure of a muffler is disclosed, wherein the muffler is divided into a front chamber, a resonance canceling chamber, and a noise canceling chamber. The front chamber is divided into an expansion chamber and a gas pressure regulating chamber. A first and a second pressure returning tubes are serially connected therebetween. As the engine rotates with a lower speed, the waste gas will flow into the expansion chamber firstly, then flows into the air pressure regulating chamber, finally returning back to the expansion chamber so that the waste gas flows into the first pressure returning tube. Further, the waste gas will flow to the resonance canceling chamber, and the noise canceling chamber so as to reduce the noise in the lower rotary speed of the engine.

The various objects and advantages of the present invention will be more readily understood from the following detailed description when read in conjunction with the appended drawing.

DETAILED DESCRIPTION OF THE PREFERRED EMBODIMENTS

Figure 1:
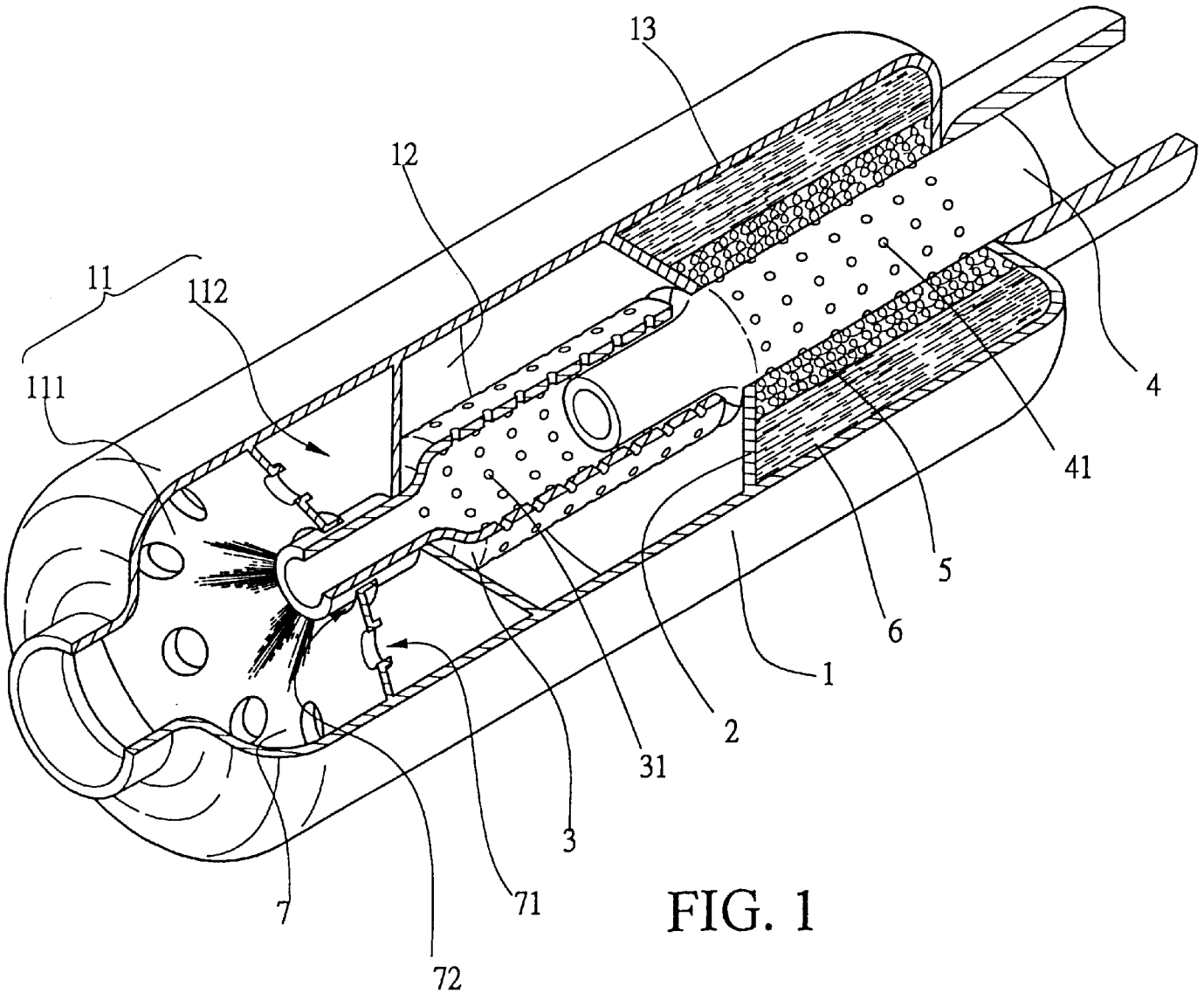
FIG. 1 is a perspective view of the present invention.
Figure 2:
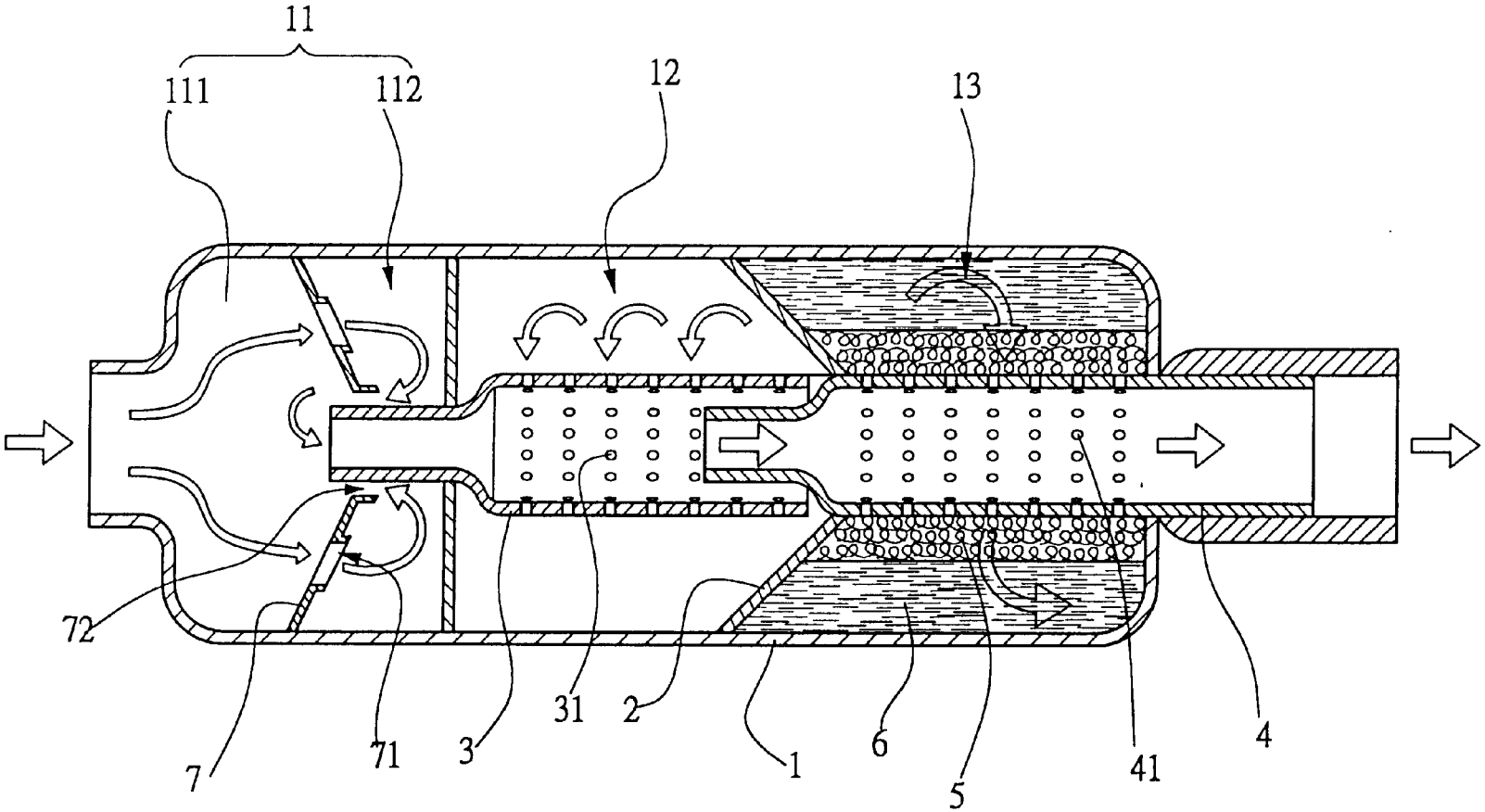
FIG. 2 is a schematic view showing the flow of the waste gas as an engine flows in a lower speed.

With reference to FIGS. 1 and 2, in the present invention, two spacers are installed within a cylinder 1. The cylinder 1 is divided into a front chamber 11, a resonance canceling chamber 12 and a noise canceling chamber 13. A first pressure returning tube 3 and a second pressure returning tube 4 are serially connected within the cylinder 1. A plurality of vents 31 and 41 are circularly installed within the first pressure returning tube 3 and the second pressure returning tube 4 so that the first pressure returning tube 3 and the second pressure returning tube 4 will pass through the front chamber 11, resonance canceling chamber 12 and noise canceling chamber 13. Stainless steel nets and voice canceling sponge 6 enclose the second pressure returning tube 4 within the noise canceling chamber 13.

A spacer 7 circularly installed with a plurality of through holes 71 is installed within the front chamber 11. The front chamber 11 is divided into an expansion chamber 111 and an air pressure regulating chamber 112. A central hole 72 is located in the center of the spacer 7. The front end of the first pressure returning tube 3 is placed in the central hole 72 of the spacer 7. A proper gap is formed between the front end of first pressure returning tube 3 and the central hole 72 of the spacer 7.

According to the aforementioned structure, as the engine rotates with a lower speed, since the waste gas is drained slowly, thus the waste gas will flow into the expansion chamber 111, then the waste gas flows into the air pressure regulating chamber 112, then returning back to the expansion chamber 111 through the gap between the central hole 72 of the spacer 7 and the first pressure returning tube 3. The waste gas flows into the first pressure returning tube 3 from the tube opening. Thus a turbulent flow is formed and noises are reduced as shown in FIG. 2.

After the waste gas flows into the first pressure returning tube 3, the waste gas will flow into the resonance canceling chamber 12 from the gas hole 31 of the first pressure returning tube 3 so as to generate a turbulent flow. Therefore, noises in the exhaustion of waste gas are reduced. Moreover, the waste gas flows back to the first pressure returning tube 3 from the gas hole 31, and then flow to the second pressure returning tube 4. After the waste gas flow into the second pressure returning tube 4, the waste gas flows into the noise canceling chamber 13 from the gas hole 13 of the second pressure returning tube 4. The stainless steel nets and voice canceling sponge 6 serves to absorb noises from the operation of engine, as shown in FIG. 2.

Figure 3:
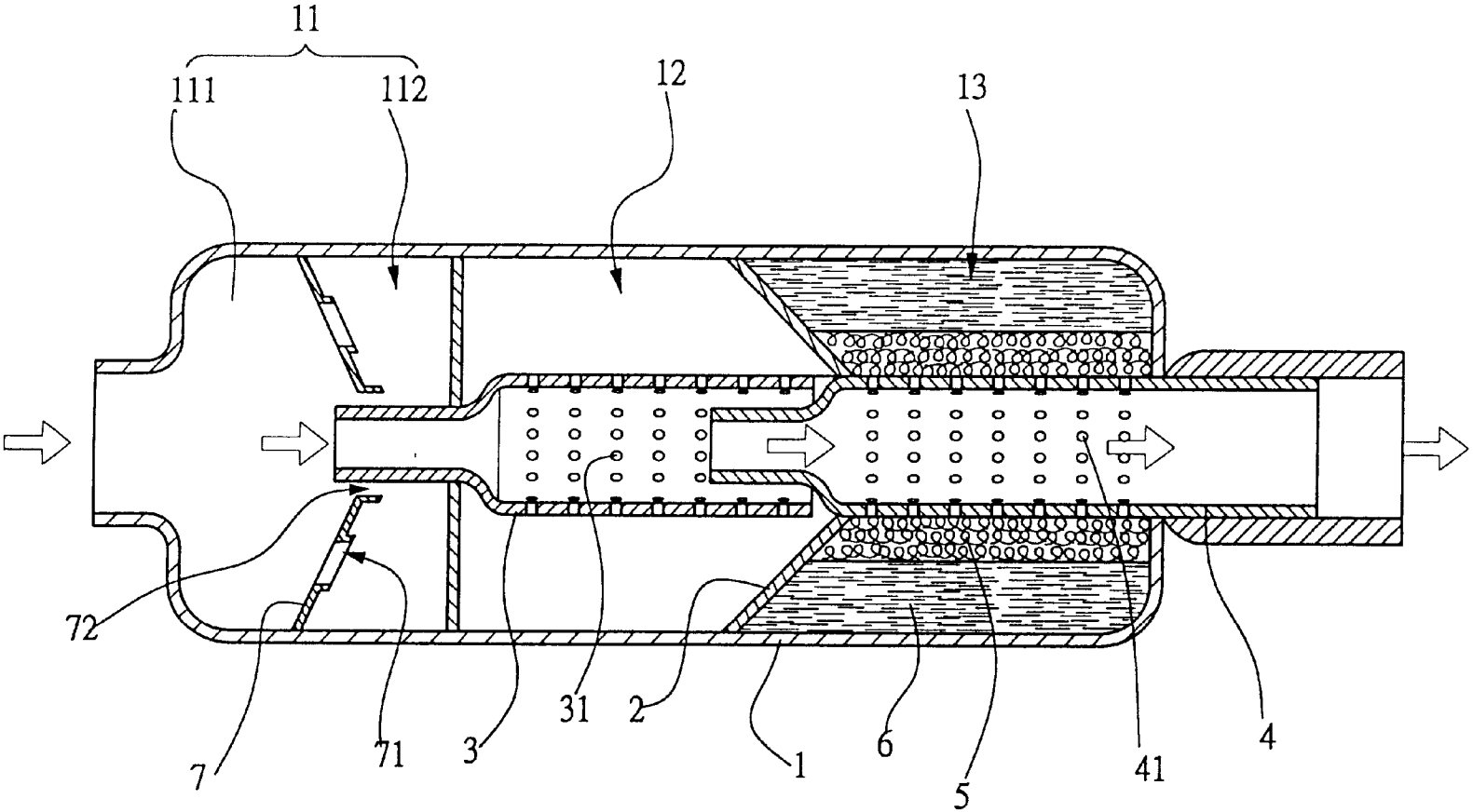
FIG. 3 is a schematic view showing the flow of the waste gas as an engine flows in a higher speed.

Moreover, when the engines operates in a high speed. Since the engine has a higher rotary speed, thus the speed for exhausting waste gas is higher. Thus, after the waste gas flows into the expansion chamber, then it will flow into the first pressure returning tube 3 and the second pressure returning tube 4 directly. Thus, the waste gas will not flow to the gas pressure regulating chamber 112 of the front chamber 11 as shown in FIG. 3. Thus, when engine operates in a higher speed, the waste gas will flow out smoothly so that the engine has a higher efficiency.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An improved structure of a muffler, wherein two spacers are installed within a cylinder, the cylinder is divided into a front chamber, a resonance canceling chamber and a noise canceling chamber, a first pressure returning tube and a second pressure returning tube are serially connected within the cylinder, a plurality of gas holes are circularly installed within the first pressure returning tube and the second pressure returning tube so that the first pressure returning tube and the second pressure returning tube pass through the front chamber, resonance canceling chamber and noise canceling chamber, stainless steel nets and noise canceling sponge enclose the second pressure returning tube within the noise canceling chamber, wherein a spacer circularly installed with a plurality of through holes is installed within the front chamber, the front chamber is divided into an expansion chamber and an air pressure regulating chamber, a central hole is located in the center of the spacer, the front end of the first pressure returning tube is placed in the central hole of the spacer, a proper gap is formed between the front end of first pressure returning tube and the central hole of the spacer.

* * * * *